US010709954B1

(12) United States Patent
Stark

(10) Patent No.: US 10,709,954 B1
(45) Date of Patent: Jul. 14, 2020

(54) RESISTANCE TRAINING EXERCISE MACHINES HAVING SAFETY LOCKING MECHANISM

(71) Applicant: Brunswick Corporation, Mettawa, IL (US)

(72) Inventor: Thomas R. Stark, Mankato, MN (US)

(73) Assignee: Life Fitness, LLC, Rosemont, IL (US)

( * ) Notice: Subject to any disclaimer, the term of this patent is extended or adjusted under 35 U.S.C. 154(b) by 123 days.

(21) Appl. No.: 15/889,386

(22) Filed: Feb. 6, 2018

(51) Int. Cl.

| | |
|---|---|
| ***A63B 21/02*** | (2006.01) |
| ***A63B 21/055*** | (2006.01) |
| ***A63B 23/12*** | (2006.01) |
| ***A63B 21/04*** | (2006.01) |
| ***A63B 71/00*** | (2006.01) |
| ***A63B 21/00*** | (2006.01) |

(52) U.S. Cl.
CPC .... *A63B 71/0054* (2013.01); *A63B 21/00058* (2013.01); *A63B 21/00065* (2013.01); *A63B 21/02* (2013.01); *A63B 21/028* (2013.01); *A63B 21/0407* (2013.01); *A63B 21/0442* (2013.01); *A63B 21/055* (2013.01); *A63B 21/0552* (2013.01); *A63B 21/0557* (2013.01); *A63B 21/154* (2013.01); *A63B 21/4035* (2015.10); *A63B 23/12* (2013.01); *A63B 2225/102* (2013.01)

(58) Field of Classification Search
CPC ..... A63B 21/00058; A63B 21/00065; A63B 21/02; A63B 21/04; A63B 21/0407; A63B 21/055; A63B 21/0557; A63B 21/153–157; A63B 21/4035; A63B 21/0442; A63B 21/028; A63B 21/0552; A63B 23/12; A63B 2225/102
See application file for complete search history.

(56) References Cited

U.S. PATENT DOCUMENTS

| | | | |
|---|---|---|---|
| 7,335,139 | B2 | 2/2008 | Bartholomew et al. |
| 7,413,532 | B1 | 8/2008 | Monsrud et al. |
| 7,597,653 | B1 | 10/2009 | Lindemeier |
| 7,887,468 | B2 | 2/2011 | Ross et al. |
| 7,981,014 | B2 | 7/2011 | Ross et al. |
| 8,968,167 | B1 * | 3/2015 | Abelbeck ..... A63B 21/0442 482/129 |

* cited by examiner

*Primary Examiner* — Loan B Jimenez
*Assistant Examiner* — Zachary T Moore
(74) *Attorney, Agent, or Firm* — Andrus Intellectual Property Law, LLP

(57) ABSTRACT

An exercise machine includes a resistance mechanism supported on a frame; a pulley system having a first end connected to the resistance mechanism and a second end configured for movement by a user performing an exercise motion. The resistance mechanism is configured to resist operation of the pulley system during the exercise motion. A selector mechanism is operable to adjust an amount of resistance provided by the resistance mechanism to operation of the pulley system. A safety locking device automatically prevents the selector mechanism from adjusting the amount of resistance once the resistance mechanism has been engaged by the user via the pulley system.

20 Claims, 9 Drawing Sheets

RESISTANCE TRAINING EXERCISE MACHINES HAVING SAFETY LOCKING MECHANISM

FIELD

The present disclosure relates to exercise machines and more particularly to resistance-type machines for weight training.

BACKGROUND

The following U.S. Patents are incorporated herein by reference:

U.S. Pat. No. 8,968,167 discloses a resistance system for an exercise device including a plurality of cord plates which may be selectively engaged by one or more pins which may include an engagement lock. One or more of the cord plates may be received by a pin with each cord plate that is received by a pin being secured relative to a frame. A cord plate that has received a pin is engaged and a cord plate that is not received by a pin is disengaged. A carriage may be provided which receives a plurality of elastic cords which may be attached to the cord plates. The carriage may be displaced relative to a base frame, to provide elongation of the elastic cords coupled to engaged cord plates and no elongation of the cords coupled to the disengaged cord plates which provide a selective resistance for a user.

U.S. Pat. No. 7,981,014 discloses a resistance system for an exercise device including a frame, a resistance element such as elastic bands, coil springs, weight plates, pneumatic or hydraulic cylinders. An interference element such as a plate, chain or one or more links is supported by a support plate mounted on the frame. Selective engagement with the resistance element is provided by actuation of a dial, other actuator or controller or directly by the user. Thereby the resistance element can be selectively engaged or disengaged to vary the resistance to the user.

U.S. Pat. No. 7,887,468 discloses a resistance system for fitness equipment including a frame, a resistance source such as an elastic cord, coil or any other type of spring, weight, pneumatic or hydraulic cylinders. The resistance source is mounted to a resistance block with a load support. A support disk is provided that is movably mounted to the frame and adapted to enable selective engagement with the load support. A transmission member, including a pliable member such as a cable, belt or other member, is coupled to the resistance source. Movement of the support disk enables selective engagement of the resistance source. In this way one or more individual resistance sources can be selectively engaged or disengaged to vary the resistance to the user by actuation of a dial or other actuator as directed by the user.

U.S. Pat. No. 7,597,653 discloses an exercise apparatus having a rotary camming disc selectively configured to engage respective locking pins for engaging and disengaging selective numbers of force resistors for varying exercise resistance.

SUMMARY

This Summary is provided to introduce a selection of concepts that are further described herein below in the Detailed Description. This Summary is not intended to identify key or essential features of the claimed subject matter, nor is it intended to be used as an aid in limiting scope of the claimed subject matter. In certain examples, an exercise machine includes a resistance mechanism supported on a frame and a pulley system having a first end connected to the resistance mechanism and a second end configured for movement by a user performing an exercise motion. The resistance mechanism is configured to resist operation of the pulley system during the exercise motion. A selector mechanism is operable to adjust an amount of resistance provided by the resistance mechanism to operation of the pulley system. A safety locking device automatically prevents the selector mechanism from adjusting the amount of resistance once the resistance mechanism has been engaged by the user via the pulley system.

DETAILED DESCRIPTION OF THE DRAWINGS

Figure 1:
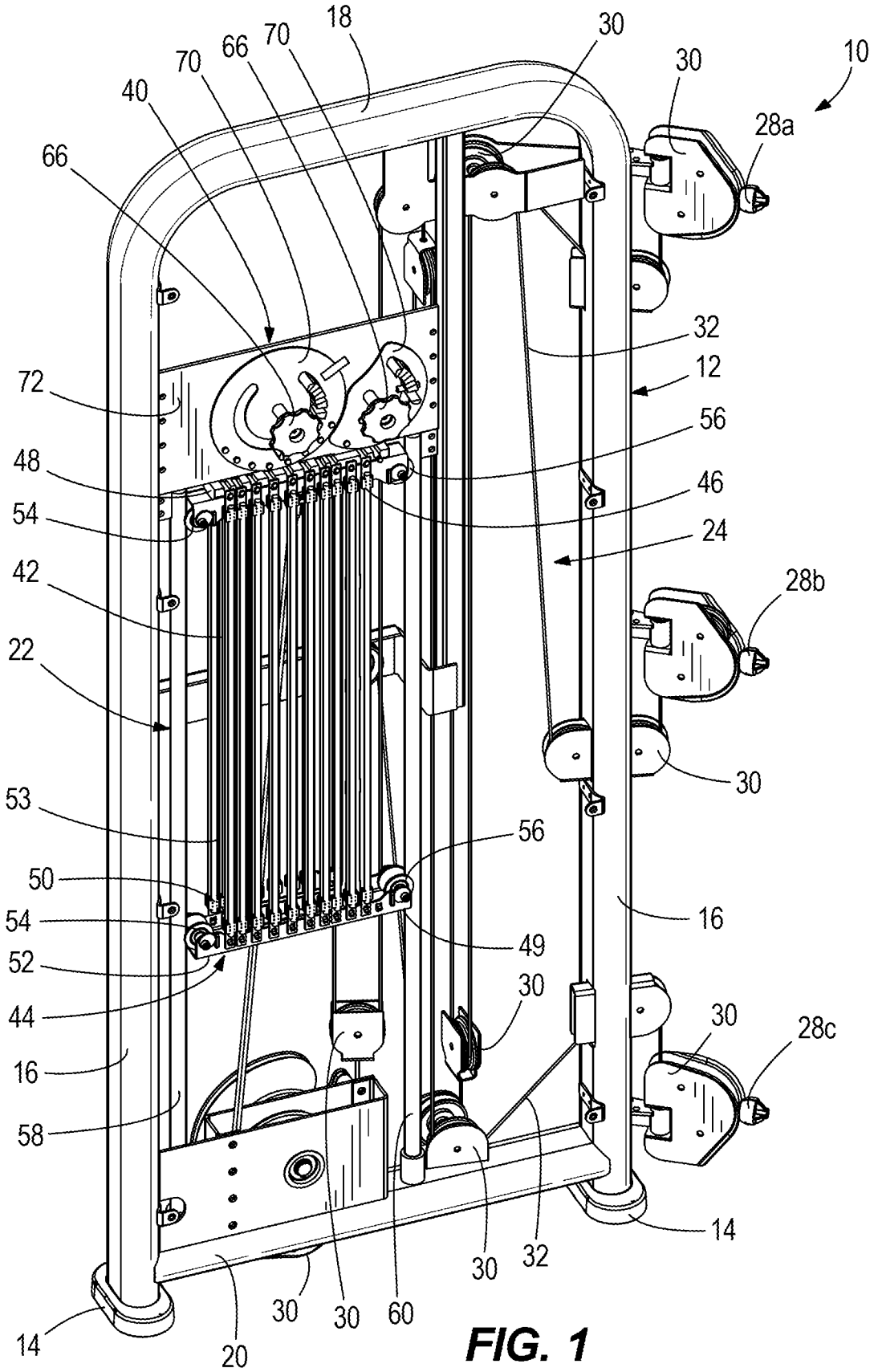
FIG. 1 is a front perspective view of an exercise machine having a resistance mechanism for resisting an exercise motion performed with respect to the machine.
Figure 2:
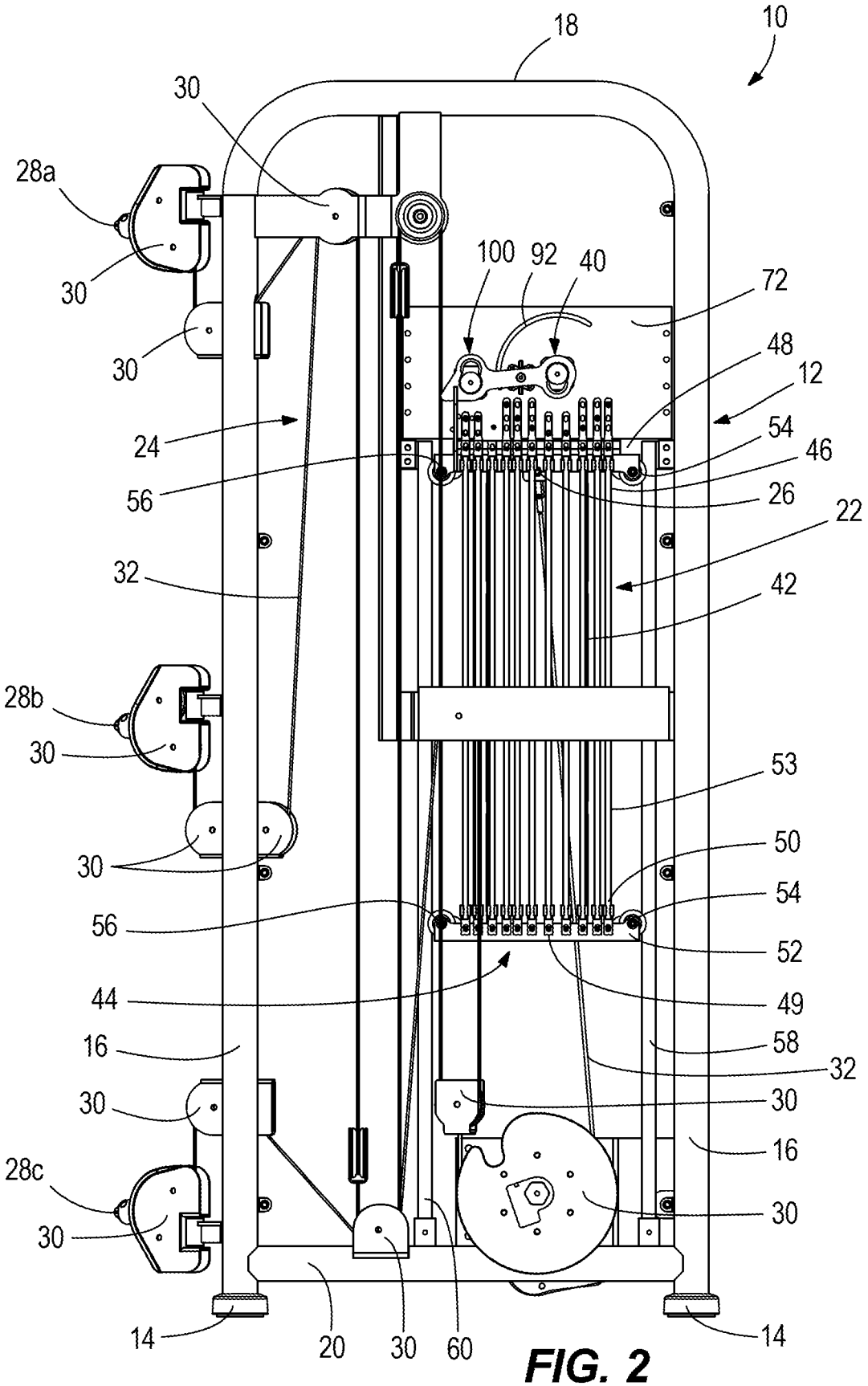
FIG. 2 is a rear view of the exercise machine.

FIGS. 1 and 2 depict an exercise machine 10 according to the present disclosure. The exercise machine 10 includes a supporting frame 12 having a pair of ground-engaging feet 14, a pair of support columns 16 that extend upwardly from the feet 14, and top and bottom cross beams 18, 20 that extend between the support columns 16. A resistance mechanism 22 is supported on the supporting frame 12. The exact configuration of the resistance mechanism 22 can vary from what is shown, and can alternately for example be configured similar to one or more of the arrangements described in the above incorporated U.S. Patents, in which a plurality of elastic resistance members 42 provide resistance to an exercise motion being performed by a user. A pulley system 24 is also supported on the supporting frame 12 and is coupled to the resistance mechanism 22 such that the resistance mechanism 22 resists operation of the pulley system 24 during the exercise motion. The pulley system 24 has pulley cables 32 that have one or more first ends 26 connected to the resistance mechanism 22 and one or more opposite, second end 28*a*, 28*b*, 28*c* configured for engagement and operation (e.g., pulling) by a user performing an exercise motion with respect to the exercise machine 10. The exercise machine 10 further includes a selector mechanism 40 that is operable by the user to adjust an amount of resistance provided by the resistance mechanism 22 to operation of the pulley system 24 prior to initiation of the exercise motion. The selector mechanism 40 is supported on a cross panel 72 that extends between the support columns 16 above the resistance mechanism 22.

The resistance mechanism 22, pulley system 24, and selector mechanism 40 will now be further described; however it should be recognized that these are merely examples and the particular configuration of these components can vary from what is shown and described.

Referring to FIGS. 1-4, the resistance mechanism 22 includes a plurality of elastic resistance members 42 that are supported on a carriage 44. The carriage 44 has an upper carriage member 48 and a lower carriage member 52 which, as is conventional, are rigidly connected to each other by vertical frame members 31 and thus movable together along the supporting frame 12. More specifically, each elastic resistance member 42 has an upper end 46 that is supported on the upper carriage member 48, a lower end 50 that is supported on the lower carriage member 52, and a pair of elongated elastic bodies 53 that extend between the upper and lower ends 46, 50 and that are disposed on opposite sides of the carriage 44, respectively. The elongated elastic bodies 53 are made of a stretchable elastic material, such as a rubber, which has a natural resiliency so that it tends to maintain its length shown in FIG. 1. The upper and lower carriage members 48, 52 each extend generally horizontally with respect to the supporting frame 12 and have opposing roller wheels 54, 56 that roll along the surface of vertical bars 58, 60 disposed on opposite sides of the carriage 44. As explained further herein below, operation of the pulley system 24 (e.g., by pulling on one or more of the second ends 28*a*, 28*b*, 28*c*) pulls the carriage 44 (which as stated above includes the upper and lower carriage members 48, 52) downwardly, as facilitated by rolling of the opposing roller wheels 54, 56 along the vertical bars 58, 60. See Arrow E in FIG. 7. The elastic resistance members 42 that are engaged by the selector mechanism 40 (as will be described further herein below) have a natural resiliency that resists downward movement of the carriage 44 and biases the upper and lower carriage members 48, 52 back upwardly, such that the carriage 44 moves back upwardly along the vertical bars 58, 60 for example when the pulley system 24 is released by the user.

Figure 6:
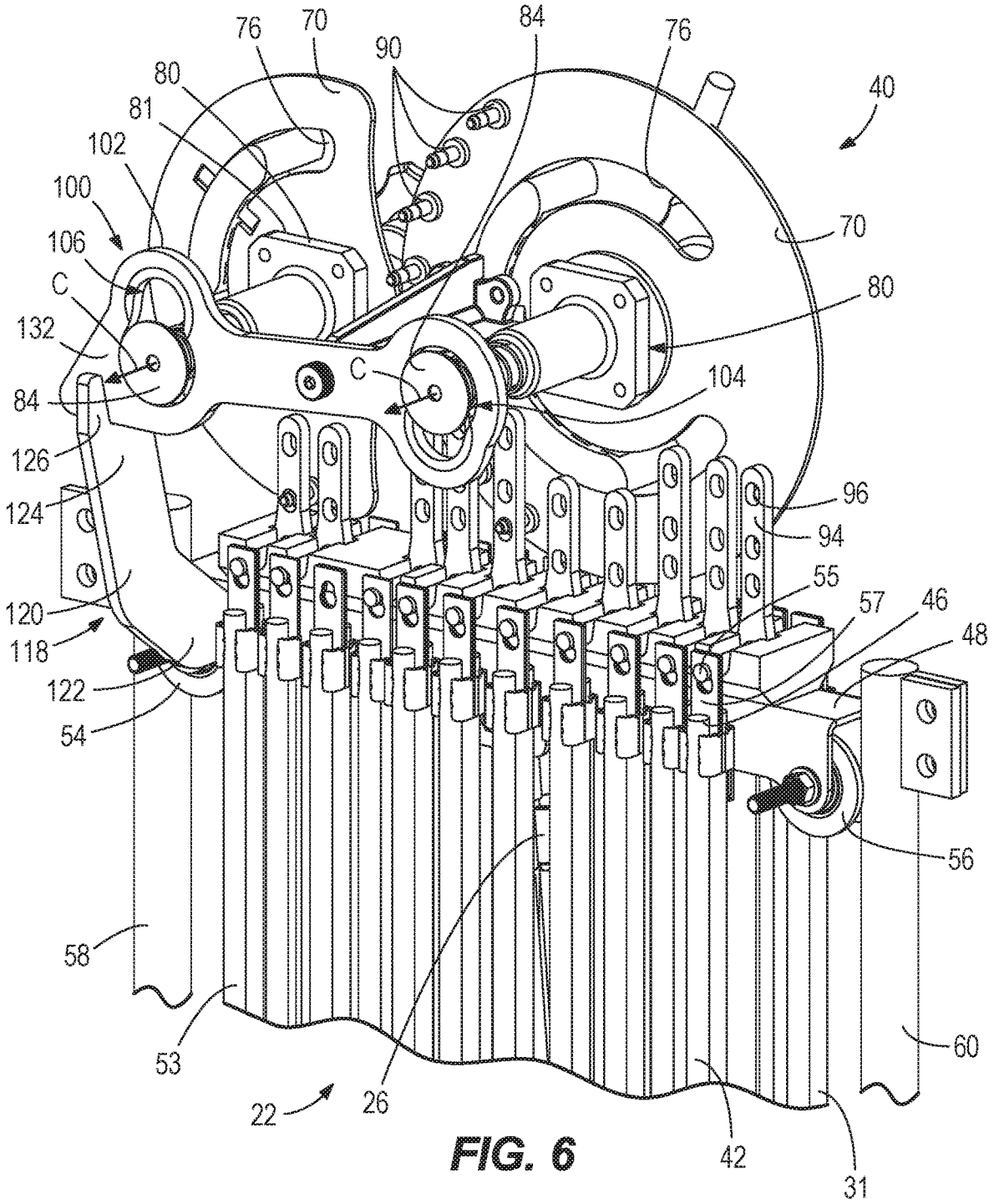
FIG. 6 is a view like FIG. 4, showing the selector mechanism after the amount of resistance has been changed.
Figure 7:
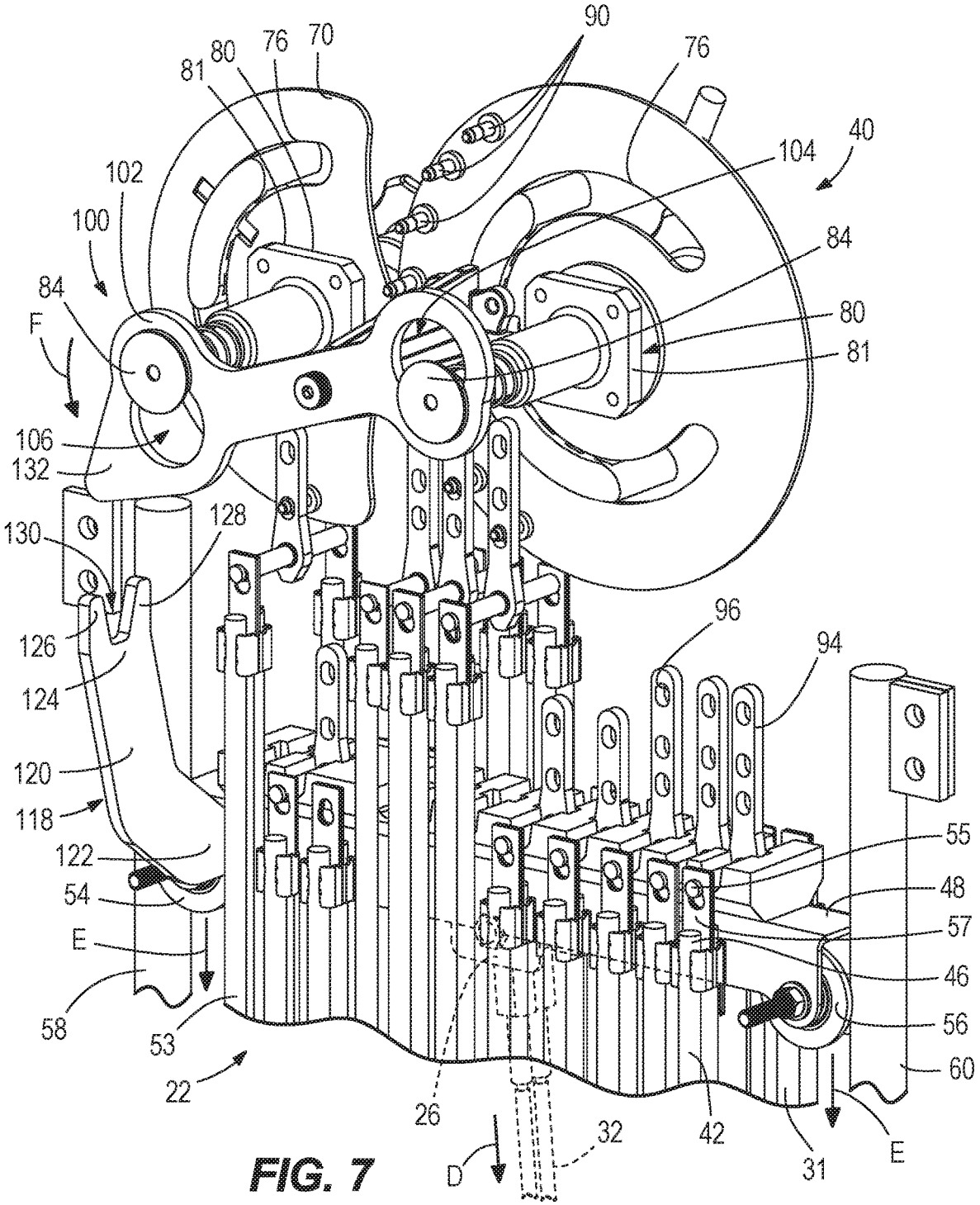
FIG. 7 is a view like FIG. 4, showing movement of the resistance mechanism and safety locking device upon initiation of the exercise motion by the user.

The elastic resistance members 42 are fixed in place with respect to the lower carriage member 52 via, for example, one or more fasteners that are engaged with lower end brackets 49 on the elastic bodies 53. The elastic resistance members 42 are movably supported with respect to the upper carriage member 48 by a cross-pin 55 (see FIGS. 4 and 5) that connects upper end brackets 57 on the elongated elastic bodies 53. When the resistance mechanism is at rest (see FIG. 4), the natural resiliency of the elastic bodies 53 causes the cross-pin 55 to seat in a corresponding recess formed in the upper carriage member 48. As explained further herein below, when the pulley system 24 is operated, the carriage 44 (including upper carriage member 48 and lower carriage member 52) is pulled downwardly with respect to any elastic resistance members 42 that are engaged with the selector mechanism 40. Downward movement of the carriage 44 with respect to the elastic resistance members 42 that are engaged with the selector mechanism 40 stretches the elastic resistance members 42, as shown by comparison of FIGS. 6 and 7, which thereby apply a resistance force on the pulley system 24. The remaining elastic resistance members 42 that are not engaged with the selector mechanism 40 are simply carried downwardly along with the carriage 44, as shown in FIG. 7. Please see the above-incorporated U.S. patents for more description of this type of resistance mechanism.

In the illustrated example, the pulley system 24 includes several pulley wheels 30 that are coupled to the supporting frame 12. The pulley system 24 further includes the pulley cable 32 having the first end 26 coupled to the resistance mechanism 22 and the opposite, second ends 28*a*, 28*b*, 28*c* which are configured for attachment to a user operable member, such as a handle, bar, rope, etc. (not shown). The pulley cable 32 extends around the various pulley wheels 30 and is configured such that pulling on one or more of the second end 28*a*, 28*b*, 28*c* pulls the pulley cable 32 about the pulley wheels 30 and pulls downwardly on the carriage 44 via its connection to the upper carriage member 48 at the first end 26. The number and location of the pulley wheels 30 and the configuration of the pulley cable 32 and its attachment to the carriage 44 is not essential and can vary from what is shown, as long as operation of the pulley system 24 causes movement of the carriage 44, e.g., as shown in FIG. 7.

Figure 3:
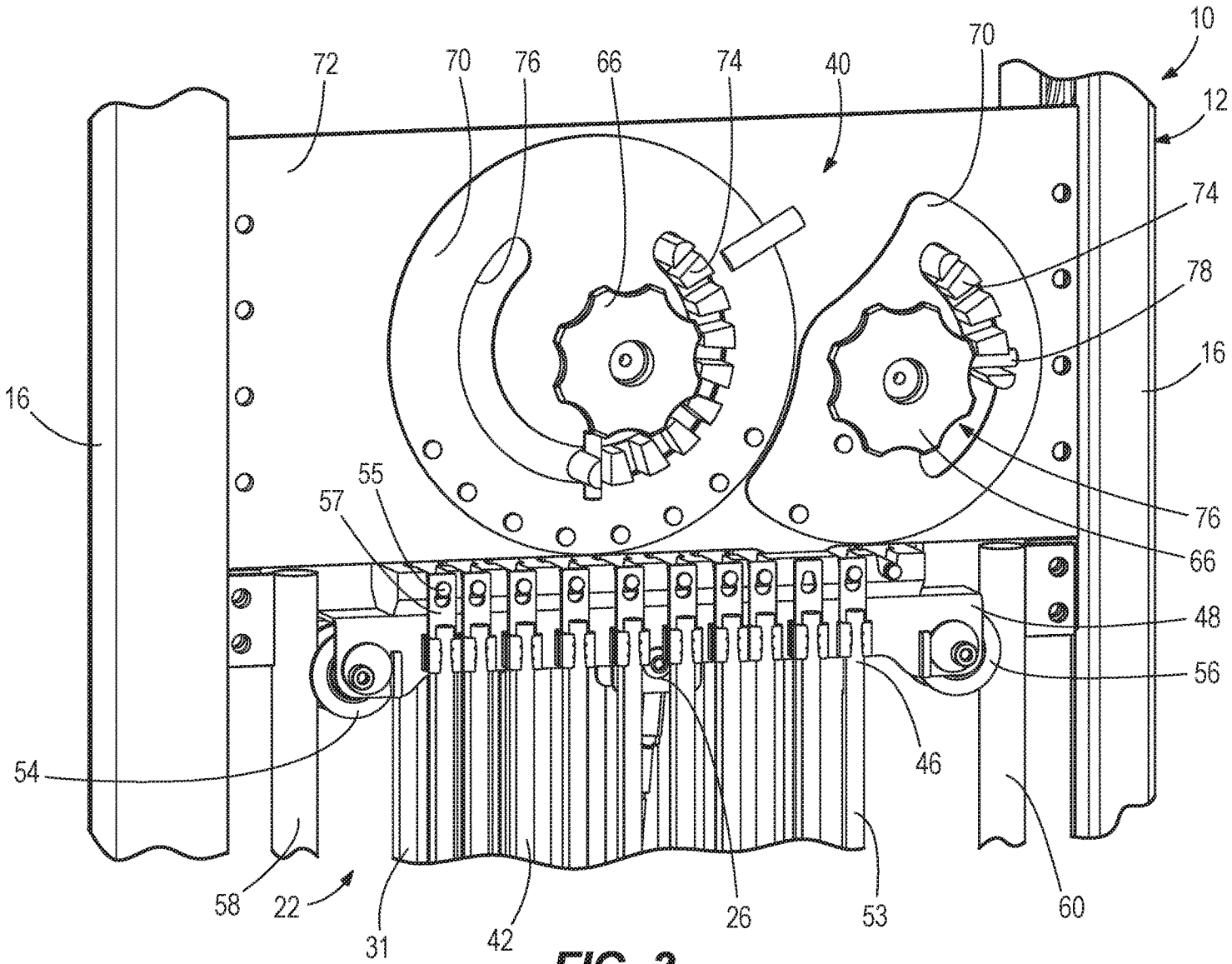
FIG. 3 is a front perspective view of a top portion of the exercise machine, showing a selector mechanism for adjusting an amount of resistance provided by the resistance mechanism.
Figure 4:
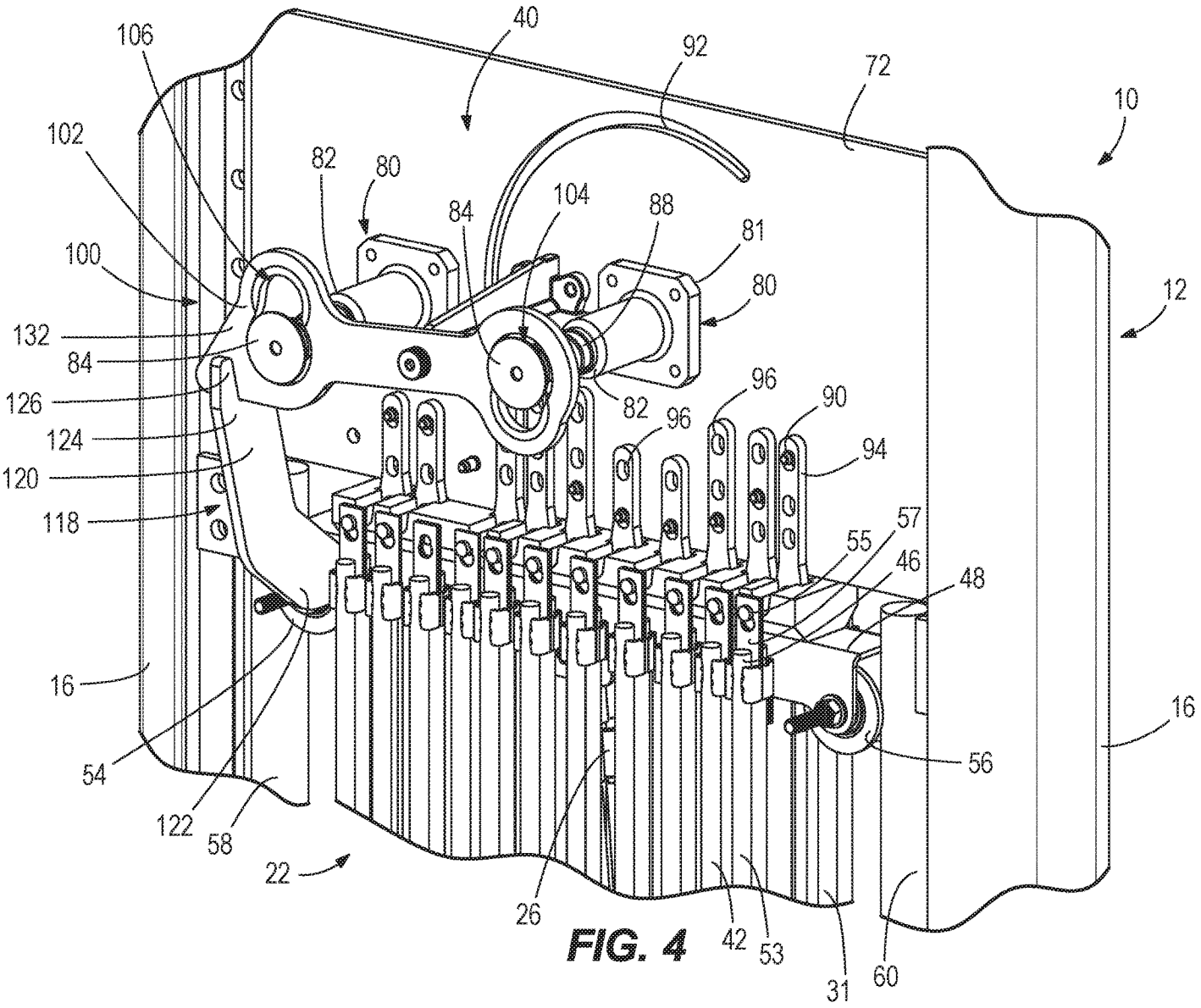
FIG. 4 is a rear perspective view of the selector mechanism, showing a safety locking device that automatically prevents the selector mechanism from adjusting the amount of resistance once the exercise motion is underway.
Figure 8:
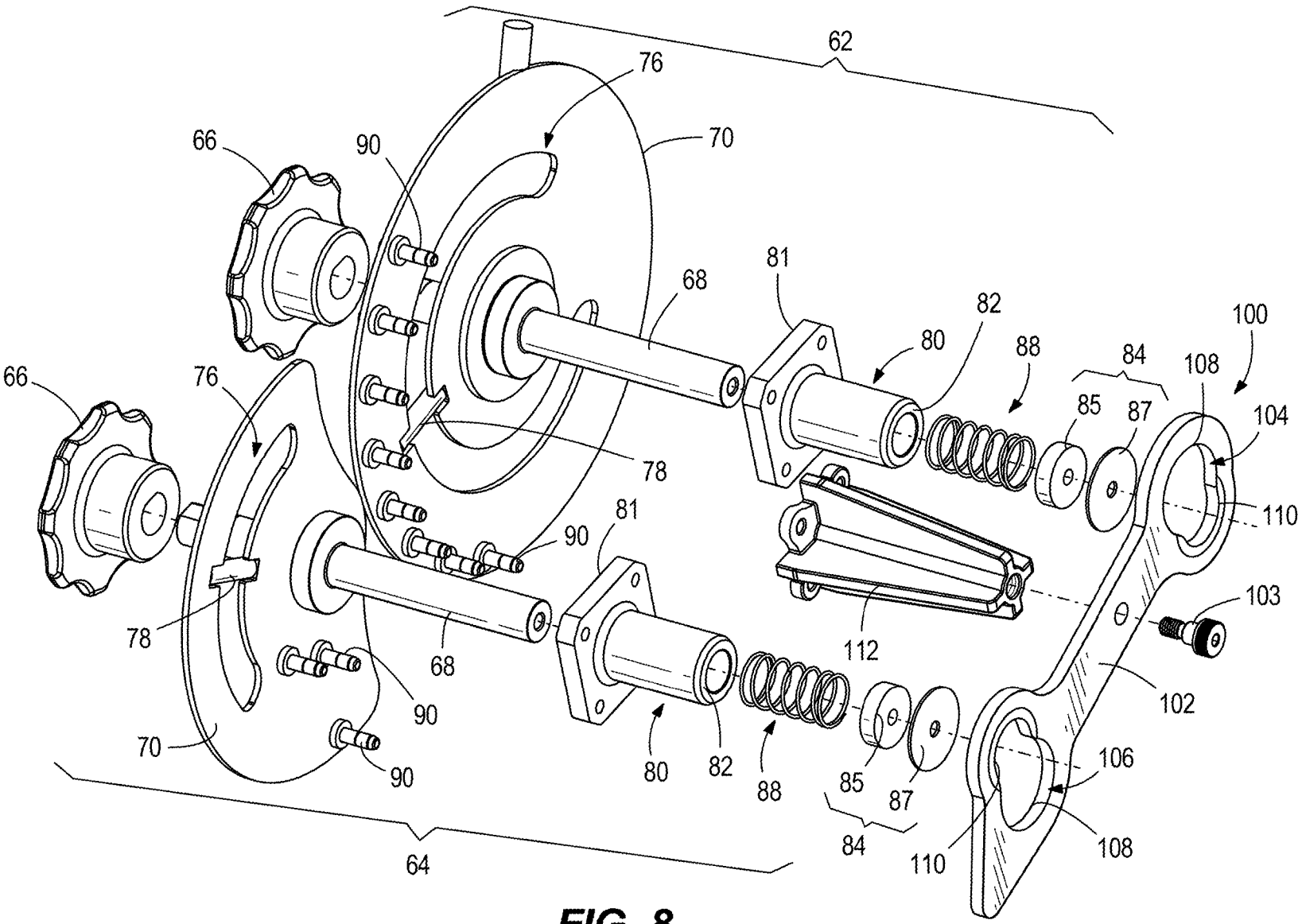
FIG. 8 is an exploded view of the selector mechanism and safety locking device.

As explained further herein below, the selector mechanism 40 is movable from a disengaged position (FIG. 5) to a plurality of engaged positions (e.g., FIGS. 4 and 6) in each of which the selector mechanism 40 is engaged with different elastic resistance members 42, respectively. In each engaged position, the resistance mechanism 22 engages with a different number of elastic resistance members 42 and thus applies a different amount of resistance to operation of the pulley system 24. Referring to FIG. 8, the selector mechanism 40 includes two selector linkages 62, 64, each having a handle 66 and a selector plate 70 that are rotatably fixed to a selector shaft 68. Referring to FIGS. 3 and 4, the selector plate 70 is located on the front of the exercise machine 10. The selector shaft 68 extends through the cross panel 72 to the back of the exercise machine 10. The cross panel 72 has a series of selector teeth 74 for each selector linkage 62, 64. The selector teeth 74 protrude outwardly from the front of the cross panel 72 into a corresponding arcuate slot 76 formed in the selector plate 70. As shown in FIGS. 3 and 8, the selector plate 70 also has a selector bar 78 that extends across the arcuate slot 76 and is configured to seat in between adjacent selector teeth 74, as for example as shown in FIG. 3. Each position of the selector bar 78 between adjacent selector teeth 74 corresponds to a particular resistance setting, as will be further described herein below.

Referring to FIGS. 4 and 8, the selector shafts 68 extend through support bearings 80 mounted on the rear of the cross panel 72. Each support bearing 80 has an inner mounting surface 81 that is mounted to the cross panel 72 by for example fasteners and an outer end surface 82 that faces away from the rear of the cross panel 72. The selector shaft 68 extends through the support bearing 80 and is rotatably supported therein. An end cap assembly 84 (in this example comprising a bearing 85 and cap 87) is coupled to the outer end 86 of the selector shaft 68. A spring 88 is disposed on the selector shaft 68 between the outer end surface 82 and the end cap assembly 84. The spring 88 has a natural bias that pushes on the outer end surface 82 of the support bearing 80 and on the end cap assembly 84, thus tending to move the selector plate 70 towards the cross panel 72 until the selector bar 78 is seated between adjacent teeth 74, for example as shown in FIG. 3.

Referring to FIGS. 4 and 8, each selector plate 70 also has a series of engagement fingers 90 that extend from the back of the selector plate 70 through an arcuate slot 92 in the cross panel 72. Referring to FIG. 4, the upper end 46 of each elastic resistance member 42 has an engagement tab 94 that is connected to and extends upwardly from the cross-pin 55. Each engagement tab 94 has one or more through-holes 96 that are generally aligned with the arcuate slot 92 when the carriage 44 is in its rest position, shown in FIG. 1. The engagement tabs 94 are thus configured for engagement with at least one of the engagement fingers 90 extending through the arcuate slot 92, depending on a rotational position of the selector mechanism 40, as will be described further herein below.

Figure 5:
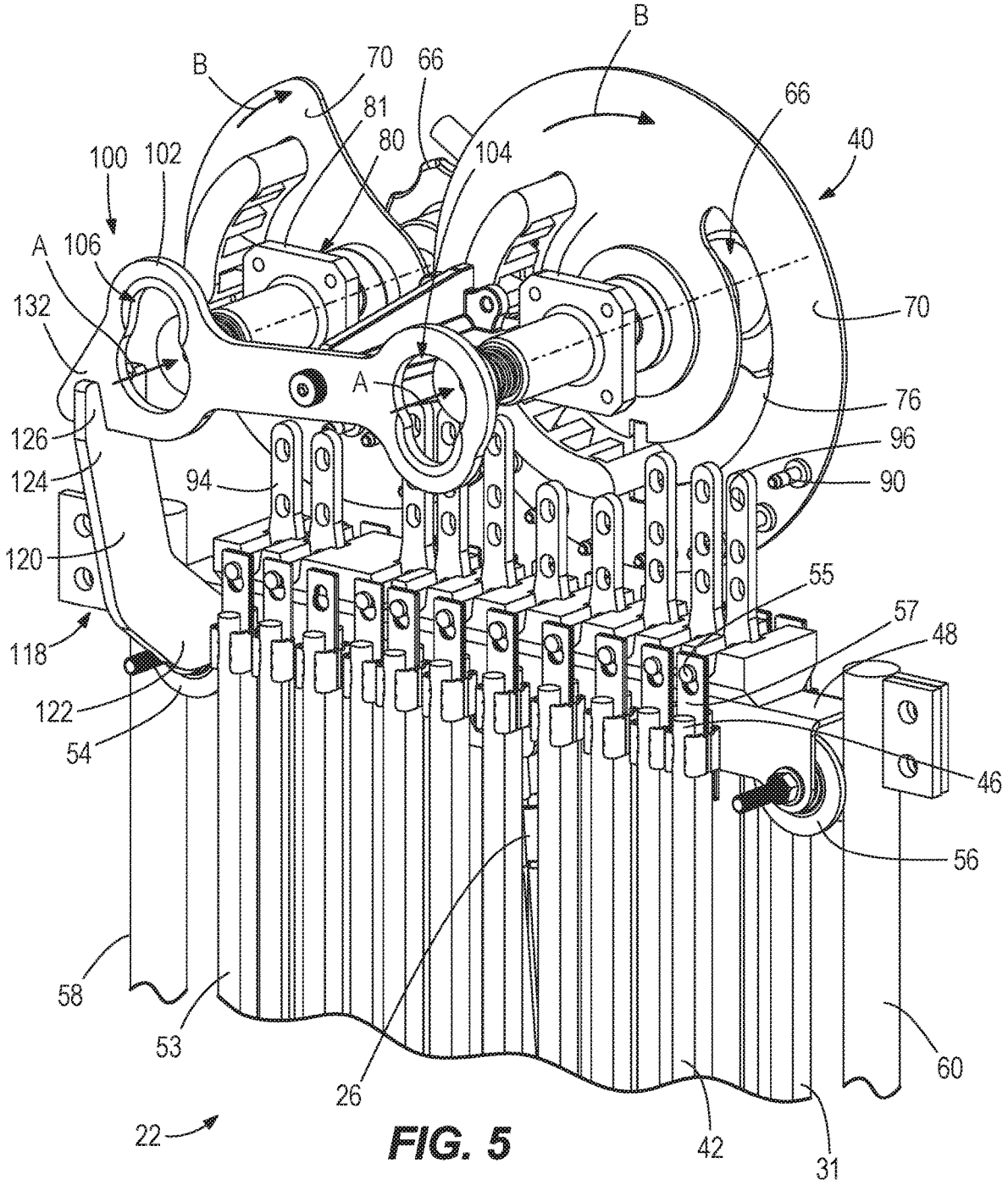
FIG. 5 is a view like FIG. 4, showing the resistance mechanism in a rest position and showing the selector mechanism being operated to change the amount of resistance.

The selector mechanism 40 is operable to adjust the amount of resistance provided by the resistance mechanism 22 by allowing the user to engage different numbers of elastic resistance members 42. Referring to FIGS. 3 and 4, each selector linkage 62, 64 of the selector mechanism 40 is normally biased by the springs 88 into engagement with the resistance mechanism 22. In particular, the springs 88 pushes the end cap assembly 84 away from the outer end surface 82 and thus pushes the engagement fingers 90 on the selector plate 70 through the arcuate slot 92 in the cross panel 72 and into a through-hole 96 of certain ones of the engagement tabs 94 of the elastic resistance members 42, depending upon the rotational position of the selector plate 70. Referring to FIG. 5, to change the resistance, the operator manually grasps the respective handle 66 and pulls the handle away from the front of the cross panel 72, as shown by Arrows A. This disengages the engagement fingers 90 from the through-holes 96, against the bias of the spring 88. Movement of the selector plate 70 outwardly away from the front of the cross panel 72 also removes the selector bar 78 out from between the selector teeth 74, thus permitting rotation of the handle 66 and selector plate 70 about the axis of the selector shaft 68, as shown at Arrows B. That is, to change the amount of resistance, the user rotates the handle 66 and associated selector shaft 68 and selector plate 70, which shifts the position of the engagement fingers 90 along the arcuate slot 92 and into alignment with different through-holes 96 of the engagement tabs 94. Then, referring to FIG. 6, when the user releases the handle 66, the bias of the spring 88 forces the selector plate 70 back towards the cross panel 72 as shown at Arrows C. This forces the selector shaft 68 out of the support bearing 80 and causes the selector bar 78 to seat between the selector teeth 74, as well as the engagement fingers 90 to engage with the through-holes 96 in the engagement tabs 94. Thereafter, referring to FIG. 7, operation of the pulley system 24 by the user during an exercise motion pulls downwardly on the carriage 44, as shown at Arrow D. Downward movement of the carriage 44, shown at Arrows E, is resisted by the elastic resistance members 42 that are engaged with the selector mechanism 40. As the pulley system 24 is released by the user, the elastic resistance members 42 naturally cause the carriage to retract back upwardly into the rest position shown in FIG. 1. Please see the above-incorporated U.S. patents for further description of similar selector mechanisms.

FIG. 4 thus depicts the resistance mechanism 22 and selector mechanism 40 in a rest position. FIG. 5 depicts the selector mechanism 40 as it is manually operated by the user to change the amount of resistance provided by the resistance mechanism 22. Specifically, the user has grasped and pulled on the handles 66, as shown by Arrows A. Pulling on the handles 66 pulls the end cap assemblies 84 thus compressing the spring 88 against the outer end surface 82. This also pulls the selector plates 70 away from the front of the cross panel 72, unseating the selector bar 78 from the recesses between the selector teeth 74 and withdrawing the engagement fingers 90 from the through-holes 96 in the engagement tabs 94. Thereafter, as shown at Arrows B, the user rotates the handle 66, which rotates the selector shafts 68 and associated selector plates 70. Rotation of the selector plates 70 causes a different number or configuration of engagement fingers 90 to become aligned with a different number or configuration of through-holes 96 in engagement tabs 94. Referring to FIG. 6, the user has manually released the handle 66, allowing the spring 88 to force the end cap assembly 84 away from the outer end surface 82, as shown at Arrows C. This forces the selector plate 70 towards the front of the cross panel 72 and causes the selector bar 78 to seat within a recess between adjacent selector teeth 74. It also causes engagement between the engagement fingers and certain through-holes 96 in engagement tabs 94, as shown in FIG. 6. Thereafter, operation of the pulley system 24, for example pulling on one or more of the second ends 28*a*, 28*b*, 28*c* pulls downwardly on the carriage 44, as shown at Arrow D, which causes the carriage 44 to travel downwardly as roller wheels 54, 56 rolls along vertical bars 58, 60, as shown at Arrows E. Thereafter, releasing the second ends 28*a*, 28*b*, 28*c* of the pulley system 24 allows the natural resiliency of the elastic resistance members 42 to pull the carriage 44 back towards the rest position, opposite the direction of Arrows E.

As mentioned above, the particular resistance mechanism 22 and selector mechanism 40 that is shown and described can vary and for example can alternately be configured similar to one or more of the arrangements disclosed in the above-incorporated patents.

Through research and experimentation, the present inventor has determined that the exercise machine 10 described above would benefit from having a safety locking device that prevents the selector mechanism 40 from being able to operate the resistance mechanism 22 once the resistance mechanism 22 has been engaged by the user via the pulley system 24. This would provide a safety feature for the exercise machine 10, preventing accidental injury in cases where the user tries to disengage the selector mechanism 40 from the resistance mechanism 22 while the exercise machine 10 is in use.

Referring to FIG. 8, the exercise machine 10 includes a safety locking device 100 that prevents the selector mechanism 40 from disengaging with the resistance mechanism 22 while the it is being operated by the user via the pulley system 24. The safety locking device 100 includes an elongated locking plate 102 having a pair of keyhole apertures 104, 106 through which the respective selector shafts 68 and end cap assembly 84 extend when the selector mechanism 40 is placed into engagement with the resistance mechanism 22, as described herein above. Each keyhole aperture 104, 106 has a large portion 108 through which the end cap assembly 84 on the selector shaft 68 can freely pass and a small portion 110 through which the end cap assembly 84 on the selector shaft 68 cannot freely pass. The locking plate 102 is pivotably coupled to the cross panel 72 on the supporting frame 12 via a pivot column 112 located between the respective selector shafts 68. The pivot column 112 has an inner end 114 fastened to the rear surface of the cross panel 72 and an outer end 116 fastened to the locking plate 102 via a fastener 103 about which the locking plate 102 is pivotable. As explained further herein below, the locking plate 102 automatically pivots with respect to the pivot column 112 into and out of locked and unlocked positions based on movement on the carriage 44 into and out of the rest position shown in FIG. 4. The selector shafts 68 and respective keyhole apertures 104, 106 are disposed on opposite sides of the pivot connection between the locking plate 102 and pivot column 112. The two keyhole apertures 104, 106 are oppositely oriented with respect to each other. That is, the aperture 104 has the large portion 108 on top of the small portion 110 and the aperture 106 has the small portion 110 on top of the large portion 108.

Referring to FIG. 4, a supporting arm 118 is connected to the upper carriage member 48 and extends upwardly from the upper carriage member 48 towards one side of the locking plate 102. Referring to FIG. 7, the supporting arm 118 includes a body 120 having a lower end 122 coupled to the upper carriage member 48 and an upper end 124 having inner and outer engagement tapered fingers 126, 128 that extend upwardly from the body 120. A recess 130 (FIG. 7) is defined between the inner and outer engagement tapered fingers 126, 128 and is sized to receive and support an outer extension 132 extending from the one side of the locking plate 102, which is located on an opposite side of the keyhole aperture 104 with respect to the pivot column 112. As shown in FIG. 4, the outer extension 132 of the locking plate 102 normally seats in the recess 130 under force of gravity when the exercise machine 10 is at rest. That is, the locking plate 102 is heavier on the side of the radially outer extension 132 such that the force of gravity causes the locking plate 102 to rotate counter-clockwise, as shown in FIG. 4. The supporting arm 118 is located and sized such that when the carriage 44 is in the rest position shown in FIG. 4, the supporting arm 118 supports the radially outer extension 132 and prevents the locking plate 102 from further rotating counter-clockwise about the pivot column 112.

As shown in FIGS. 4-6, when the carriage 44 is at rest, the supporting arm 118 supports the locking plate 102 such that the large portions 108 of the keyhole apertures 104, 106 are coaxial with the axial centers of the selector shaft 68 and associated end cap assemblies 84. As such, at rest, the selector shaft 68 and end cap assemblies 84 of the selector linkages 62, 64 are freely movable in the axial direction into and out of the keyhole apertures 104, 106 of the locking plate 102, as shown by comparison of FIGS. 4 and 5. Referring to FIG. 7, when the pulley system 24 is operated by the user, the carriage 44 is lowered, as described herein above. The supporting arm 118 travels downwardly with the carriage 44, thus allowing the locking plate 102 to freely pivot about the pivot column 112 under the force of gravity, in the counterclockwise direction shown by Arrow F in FIG. 7. Counterclockwise pivoting of the locking plate 102 causes the small portions 110 of the keyhole apertures 104, 106 to become aligned with and rest on the selector shaft 68, between the end cap assembly 84 and the outer end surface 82. This effectively prevents subsequent axial movement of the selector shaft 68 in the direction of Arrows C in FIG. 5 via manual pulling of the handle 66, as described herein above. That is, the end cap assembly 84 is too large to pass through the small portion 110 of the keyhole apertures 104, 106, thus preventing axial travel of the selector shaft 68 while the pulley system 24 and resistance mechanism 22 is being operated. Once the exercise motion is complete and the pulley system 24 is manually released by the user, the carriage 44 is biased back up into the rest position shown in FIG. 4 by the elastic resistance members 42 that are engaged by the selector mechanism 40, as described herein above, wherein the supporting arm 118 via recess 130 engages the radially outer extension 132 of the locking plate 102 and causes it to rotate clockwise back into the rest position shown in FIG. 4, wherein subsequent movement of the selector shaft 68 is freely permitted via the large portion 108 of the keyhole apertures 104, 106 to allow a change in resistance, all as described herein above.

It will thus be understood that operation of the resistance mechanism 22 via the pulley system 24 automatically causes the safety locking device 100 to move by gravity from an unlocked position (FIG. 4) in which the selector mechanism 40 is operable to adjust the amount of resistance to a locked position (FIG. 7) in which the selector mechanism 40 is prevented from adjusting the amount of resistance. As operation of the resistance mechanism 22 ceases, the safety locking device 100 is automatically caused to move from the locked position to the unlocked position. Normally, the safety locking device 100 moves under force of gravity from the unlocked position (FIG. 4) to the locked position (FIG. 7) as permitted by downward movement of the supporting arm 118.

It will further been understood that the selector mechanism 40 is movable from a disengaged position into any one of a plurality of engaged positions with respect to the resistance mechanism 22, each engaged position causing the resistance mechanism 22 to provide a different amount of resistance to operation of the pulley system 24. The safety locking device 100 engages the selector mechanism 40, and automatically prevents the selector mechanism 40 from moving out engagement with the resistance mechanism 22.

It will further be understood that the selector mechanism 40 is biased into engagement with the resistance mechanism 22 via the spring 88. The selector mechanism 40 is movable against the bias, out of engagement with the resistance mechanism 22 under manual force. The safety locking device 100 engages the selector mechanism 40 and prevents the selector mechanism 40 from moving out of engagement with the resistance mechanism 22 when the pulley system is in use.

It will further be understood that axially moving the selector mechanism 40 out of engagement with the resistance mechanism 22, then rotating the selector mechanism 40, and then manually releasing the selector mechanism 40 causes the selector mechanism 40 to automatically move under force of the spring 88 back into engagement with the resistance mechanism 22 and thereby select a new amount of resistance provided by the resistance mechanism 22 to operation of the pulley system 24.

Movement of the pulley system 24 moves the carriage 44 out of the noted rest position (FIG. 4), which causes the safety locking device 100 to automatically engage with the selector mechanism 40, so as to prevent a subsequent change in the amount of resistance via the selector mechanism 40. Releasing of the pulley system 24 by the user allows the elastic resistance members 42 to move the carriage 44 back into the rest position which automatically disengages the safety locking device 100 from the selector mechanism 40, so as to allow a subsequent change in the amount of resistance via the selector mechanism 40.

In the illustrated example, the safety locking device 100 includes the locking plate 102 that engages with the selector mechanism 40 when the carriage 44 is moved out of the rest position. The carriage 44 includes the supporting arm 118 that engages with and moves the locking plate 102 out of engagement with the selector mechanism 40 when the carriage 44 is moved into the rest position.

Figure 9:
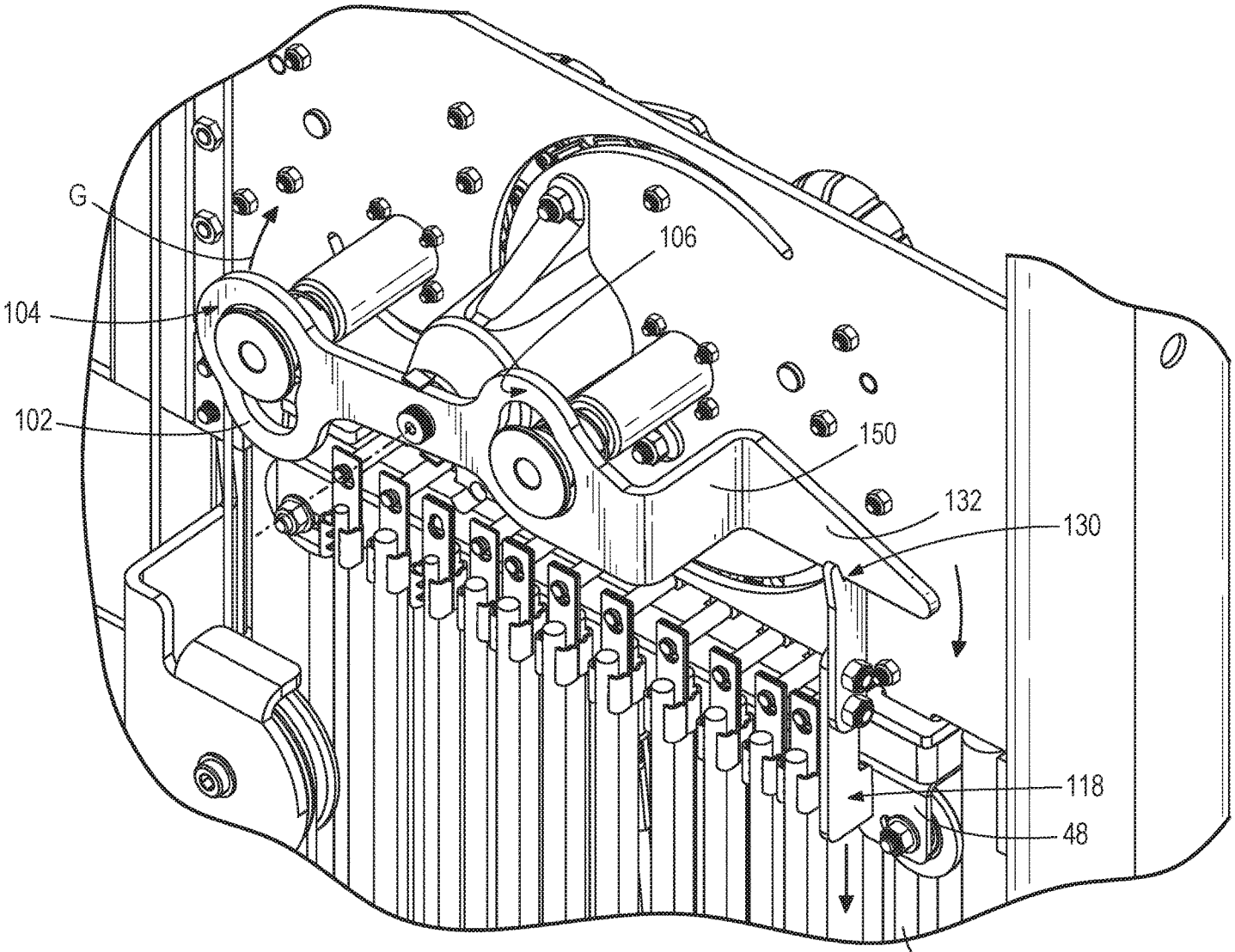
FIG. 9 is a view like FIG. 4, showing an alternate embodiment

FIG. 9 depicts an alternate embodiment wherein the locking plate 102 is configured to rotate in an opposite direction G compared to the embodiment shown in FIGS. 1-8. The supporting arm 118 extends upwardly from its connection to the upper carriage member 48. The locking plate 102 has an extension 150 that extends transversely to the front of the locking plate 102 so as to align the extension 132 with the recess 130 in the top portion of the supporting arm 118.

In the present description, certain terms have been used for brevity, clearness and understanding. No unnecessary limitations are to be implied therefrom beyond the requirement of the prior art because such terms are used for descriptive purposes only and are intended to be broadly construed. The different systems, methods and apparatuses described herein may be used alone or in combination with other systems, methods and apparatuses. Various equivalents, alternatives and modifications are possible within the scope of the appended claims.

What is claimed is:

1. An exercise machine comprising:

a resistance mechanism supported on a frame;

a pulley system having a first end connected to the resistance mechanism and a second end configured for movement by a user performing an exercise motion, wherein the resistance mechanism is configured to resist operation of the pulley system by the user during the exercise motion;

a selector mechanism that is operable to adjust an amount of resistance provided by the resistance mechanism to operation of the pulley system; and a safety locking device, wherein operation of the resistance mechanism via the pulley system causes the safety locking device to automatically move from an unlocked position in which the selector mechanism is operable to adjust the amount of resistance to a locked position in which the selector mechanism is prevented from adjusting the amount of resistance, and wherein when operation of the resistance mechanism ceases, the safety locking device is automatically caused to move from the locked position to the unlocked position.

2. An exercise machine comprising:

a resistance mechanism supported on a frame;

a pulley system having a first end connected to the resistance mechanism and a second end configured for movement by a user performing an exercise motion, wherein the resistance mechanism is configured to resist operation of the pulley system by the user during the exercise motion;

a selector mechanism that is operable to adjust an amount of resistance provided by the resistance mechanism to operation of the pulley system;

a safety locking device that automatically prevents the selector mechanism from adjusting the amount of resistance once the resistance mechanism has been engaged by the user via the pulley system; and wherein operation of the resistance mechanism via the pulley system causes the safety locking device to automatically move from an unlocked position in which the selector mechanism is operable to adjust the amount of resistance to a locked position in which the selector mechanism is prevented from adjusting the amount of resistance, and wherein when operation of the resistance mechanism ceases, the safety locking device is automatically caused to move from the locked position to the unlocked position.

3. The exercise machine according to claim 2, wherein the safety locking device automatically moves under force of gravity from the unlocked position to the locked position.

4. The exercise machine according to claim 1, wherein the selector mechanism is movable from a disengaged position into a plurality of engaged positions with respect to the resistance mechanism, each engaged position in the plurality of engaged positions causing the resistance mechanism to provide a different amount of resistance to operation of the pulley system.

5. The exercise machine according to claim 4, wherein the safety locking device engages the selector mechanism and prevents the selector mechanism from moving out of engagement with the resistance mechanism.

6. The exercise machine according to claim 1, wherein the selector mechanism is biased into engagement with the resistance mechanism, and wherein the selector mechanism is movable against the bias, out of engagement with the resistance mechanism, and wherein the safety locking device automatically engages the selector mechanism and prevents the selector mechanism from moving out of engagement with the resistance mechanism.

7. The exercise machine according to claim 6, wherein the selector mechanism is rotatable, wherein moving the selector mechanism out of engagement with the resistance mechanism, rotating the selector mechanism, and then manually releasing the selector mechanism causes the selector mechanism to automatically move back into engagement with the resistance mechanism and thereby selects the amount of resistance provided by the resistance mechanism to operation of the pulley system.

8. The exercise machine according to claim 1, wherein the resistance mechanism comprises a plurality of elastic resistance members that are supported by a carriage.

9. The exercise machine according to claim 8, wherein operation of the pulley system causes the carriage to move with respect to the selector mechanism, extending selected elastic resistance members in the plurality of elastic resistance members that are engaged by the selector mechanism, and wherein a natural resiliency of the selected elastic resistance members resists operation of the pulley system.

10. The exercise machine according to claim 9, wherein operation of the pulley system moves the carriage out of a rest position, which automatically causes the safety locking device to engage with the selector mechanism so as to prevent a subsequent change in the amount of resistance via the selector mechanism.

11. An exercise machine comprising:

a resistance mechanism supported on a frame;

a pulley system having a first end connected to the resistance mechanism and a second end configured for movement by a user performing an exercise motion, wherein the resistance mechanism is configured to resist operation of the pulley system by the user during the exercise motion;

a selector mechanism that is operable to adjust an amount of resistance provided by the resistance mechanism to operation of the pulley system;

a safety locking device that automatically prevents the selector mechanism from adjusting the amount of resistance once the resistance mechanism has been engaged by the user via the pulley system;

wherein the resistance mechanism comprises a plurality of elastic resistance members that are supported by a carriage;

wherein operation of the pulley system causes the carriage to move with respect to the selector mechanism, extending selected elastic resistance members in the plurality of elastic resistance members that are engaged by the selector mechanism, and wherein a natural resiliency of the selected elastic resistance members resists operation of the pulley system;

wherein operation of the pulley system moves the carriage out of a rest position, which automatically causes the safety locking device to engage with the selector mechanism so as to prevent a subsequent change in the amount of resistance via the selector mechanism; and wherein movement of the carriage out of the rest position allows the safety locking device to move under force of gravity into locking engagement with the selector mechanism.

12. The exercise machine according to claim 11, wherein releasing of the pulley system by the user allows the elastic resistance members to move the carriage back into the rest position, which disengages the safety locking device from the selector mechanism so as to allow a subsequent change in the amount of resistance via the selector mechanism.

13. The exercise machine according to claim 12, wherein the safety locking device comprises a locking plate that engages with the selector mechanism and wherein the carriage is moved out of the rest position and wherein the carriage comprises a supporting arm that moves the locking plate out of engagement with the selector mechanism when the carriage is moved into in the rest position.

14. The exercise machine according to claim 13, wherein the selector mechanism comprises a selector shaft and wherein the locking plate comprises an aperture through which the selector shaft extends when the selector mechanism selects the amount of resistance provided by the resistance mechanism to the pulley system.

15. The exercise machine according to claim 14, wherein the selector shaft is biased into engagement with the resistance mechanism, and wherein the selector shaft is movable against the bias, out of engagement with the resistance mechanism, and wherein the locking plate engages the selector shaft and prevents the selector shaft from moving out of engagement with the resistance mechanism.

16. The exercise machine according to claim 15, wherein the aperture comprises a large portion through which the selector shaft can freely pass and a small portion through which the selector shaft cannot freely pass, wherein movement of the carriage into the rest position causes the support surface to move the locking plate into an unlocked position in which the selector shaft extends through the large portion of the aperture, and wherein movement of the carriage out of the rest position causes gravity to move the locking plate into a locked position in which the selector shaft extends through the small portion of the aperture.

17. The exercise machine according to claim 16, wherein the locking plate is coupled to the frame via a pivot connection so that the locking plate is pivotable into and out of the unlocked and locked positions based on movement of the carriage into and out of the rest position.

18. The exercise machine according to claim 17, wherein the selector shaft is one of two selector shafts that are disposed on opposite sides of the pivot connection and wherein the aperture is one of two keyhole apertures that are disposed on opposite sides of the pivot connection.

19. The exercise machine according to claim 18, wherein the two keyhole apertures are oppositely oriented with respect to each other, such that one of the two keyhole apertures has the large portion on top of the small portion and the other of the two keyhole apertures has the large portion below the small portion, and such that pivoting of the locking plate moves both keyhole apertures into the locked position with respect to the two selector shafts and opposite pivoting of the locking plate moves both keyhole apertures into the unlocked position with respect to the two selector shafts.

20. The exercise machine according to claim 1, wherein the pulley system comprises a pulley wheel coupled to the frame and a pulley cable coupled to the resistance mechanism and extending around the pulley wheel.

* * * * *